US009315349B2

(12) United States Patent
Uchino

(10) Patent No.: US 9,315,349 B2
(45) Date of Patent: Apr. 19, 2016

(54) FEED APPARATUS AND IMAGE RECORDING APPARATUS

(71) Applicant: BROTHER KOGYO KABUSHIKI KAISHA, Nagoya-shi, Aichi-ken (JP)

(72) Inventor: Yuta Uchino, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/670,091

(22) Filed: Mar. 26, 2015

(65) Prior Publication Data

US 2015/0274458 A1 Oct. 1, 2015

(30) Foreign Application Priority Data

Mar. 31, 2014 (JP) ..... 2014-072214

(51) Int. Cl.

| | |
|---|---|
| ***B65H 3/06*** | (2006.01) |
| ***B65H 5/06*** | (2006.01) |
| ***B65H 1/08*** | (2006.01) |
| ***B65H 3/02*** | (2006.01) |

(52) U.S. Cl.

CPC .. *B65H 5/06* (2013.01); *B65H 1/08* (2013.01); *B65H 3/02* (2013.01); *B65H 2405/1124* (2013.01); *B65H 2405/111646* (2013.01)

(58) Field of Classification Search

CPC ..... B65H 2405/1122; B65H 2405/1124; B65H 2405/111646

USPC ..... 271/122, 162

See application file for complete search history.

(56) References Cited

U.S. PATENT DOCUMENTS

| | | | | |
|---|---|---|---|---|
| 5,624,107 | A * | 4/1997 | Deguchi et al. | 271/3.2 |
| 7,401,774 | B2 * | 7/2008 | Ginzton | 271/124 |
| 7,455,285 | B2 * | 11/2008 | Goh et al. | 271/3.14 |
| 2014/0292971 | A1 * | 10/2014 | Uchino | B41J 13/103 347/104 |

FOREIGN PATENT DOCUMENTS

JP 2001-106346 A 4/2001

* cited by examiner

*Primary Examiner* — Howard Sanders
(74) *Attorney, Agent, or Firm* — Merchant & Gould P.C.

(57) ABSTRACT

There is provided a feed apparatus including: a fixed support unit having a first support surface configured to support a sheet; a movable support unit having a second support surface configured to support the sheet and configured to move to a first position where the first support surface and the second support surface form one flat surface substantially and to a second position where the second support surface intersects with the first support surface with respect to the fixed support unit; a feed roller configured to feed the sheet supported by the second support surface of the movable support unit positioned at the first position and the first support surface in a feed direction; an arm having one end portion configured to rotatably support the feed roller and the other end portion configured to be swingable with respect to a shaft provided in the fixed support unit; and a separating pad provided at a position, being a position, of the first support surface, including the end on the second support surface side, opposed to the feed roller. The end of a surface of the separating pad on the second support surface side is curved downward rather than the second support surface positioned at the first position.

5 Claims, 9 Drawing Sheets

FEED APPARATUS AND IMAGE RECORDING APPARATUS

CROSS REFERENCE TO RELATED APPLICATION

The present application claims priority from Japanese Patent Application No. 2014-072214 filed on Mar. 31, 2014 the disclosure of which is incorporated herein by reference in its entirety.

BACKGROUND

1. Field of the Invention

The present invention relates to a feed apparatus feeding a sheet supported by a support unit and an image recording apparatus including the feed apparatus.

2. Description of the Related Art

There is conventionally known a feed apparatus configured such that a support unit in a state of being inclined supports a plurality of sheets stacked thereon and each of the sheets is fed obliquely downward along the inclination of the support unit. In this feed apparatus, each sheets supported by the support unit is fed in a feed direction by a feed roller. In order to prevent overlapped feed, which means that the plurality of sheets is fed in a state of being overlapped, in the support unit, a separating pad such as a cork, which is likely to cause friction with a sheet, is provided at the position opposed to the feed roller.

SUMMARY

According to the findings of the inventors, in order to reduce the area of the support unit in a state of being inclined occupying a placement surface of the apparatus, namely in order to achieve downsizing of the apparatus, there is considered a constitution to enable a part of the support unit to swing in a vertical direction along the direction of gravitational force. In the constitution to make a part of the support unit swing, a support surface for a sheet is divided along a swing shaft. Two divided support surfaces preferably form the same flat surface as much as possible, but due to a backlash of swing, or the like, it is difficult to form the perfect same flat surface with the two support surfaces. That is, it is common that a difference in height is made between the two support surfaces.

In order to achieve downsizing of the apparatus, the support unit desirably has a large swingable movable portion. Meanwhile, the distance from the feed roller to a curved or bent portion of a conveyance path is set in consideration of strength of various sheets (what is called stiffness of sheets). In order to meet these conditions, the feed roller and the separating pad are sometimes laid out at a position close to the movable portion. However, when the separating pad is laid out near the swing shaft, due to the difference in height between the two support surfaces, an angle at which a sheet comes into contact with the separating pad, or the like becomes unstable, resulting in that there is a risk that the sheet comes up with respect to the separating pad. As a result, the performance of the separating pad is not exhibited, to thus increase the risk that a plurality of sheets is fed in a state of being overlapped.

The present teaching has been made to solve the foregoing problems, an object of which is to provide a mechanism capable of achieving downsizing of an apparatus and capable of reducing the possibility of occurrence of overlapped feed of sheets by a sheet abutting against a separating pad stably.

According to a first aspect of the present teaching, there is provided a feed apparatus configured to feed a sheet, including:

a fixed support unit having a first support surface configured to support the sheet;

a movable support unit having a second support surface configured to support the sheet and configured to move to a first position where the first support surface and the second support surface form one flat surface substantially and to a second position where the second support surface intersects with the first support surface with respect to the fixed support unit;

a feed roller configured to feed the sheet supported by the second support surface of the movable support unit positioned at the first position and the first support surface in a feed direction;

an arm having one end portion configured to rotatably support the feed roller and the other end portion configured to be swingable with respect to a shaft provided in the fixed support unit; and a separating pad provided at a position, being a position, of the first support surface, including the end on the second support surface side, opposed to the feed roller, in which the end of a surface of the separating pad on the second support surface side is curved downward rather than the second support surface positioned at the first position.

Thereby, it is possible to prevent that the movable support unit comes into contact with the separating pad, to thereby cause abrasion and peeling of the separating pad. Further, the sheet supported by the second support surface does not abut against the edge of the separating pad, and the state of the sheet abutting against the separating pad is stabilized.

According to the present teaching, downsizing of the apparatus is achieved by bringing the movable support unit to the second position. Further, it is possible to prevent the movable support unit from coming into contact with the separating pad when it swings. Further, the sheet does not abut against the edge of the separating pad and the sheet abuts against the separating pad stably, resulting in that the possibility of occurrence of overlapped feed of sheets can be reduced.

DETAILED DESCRIPTION OF THE EMBODIMENTS

Figure 1:
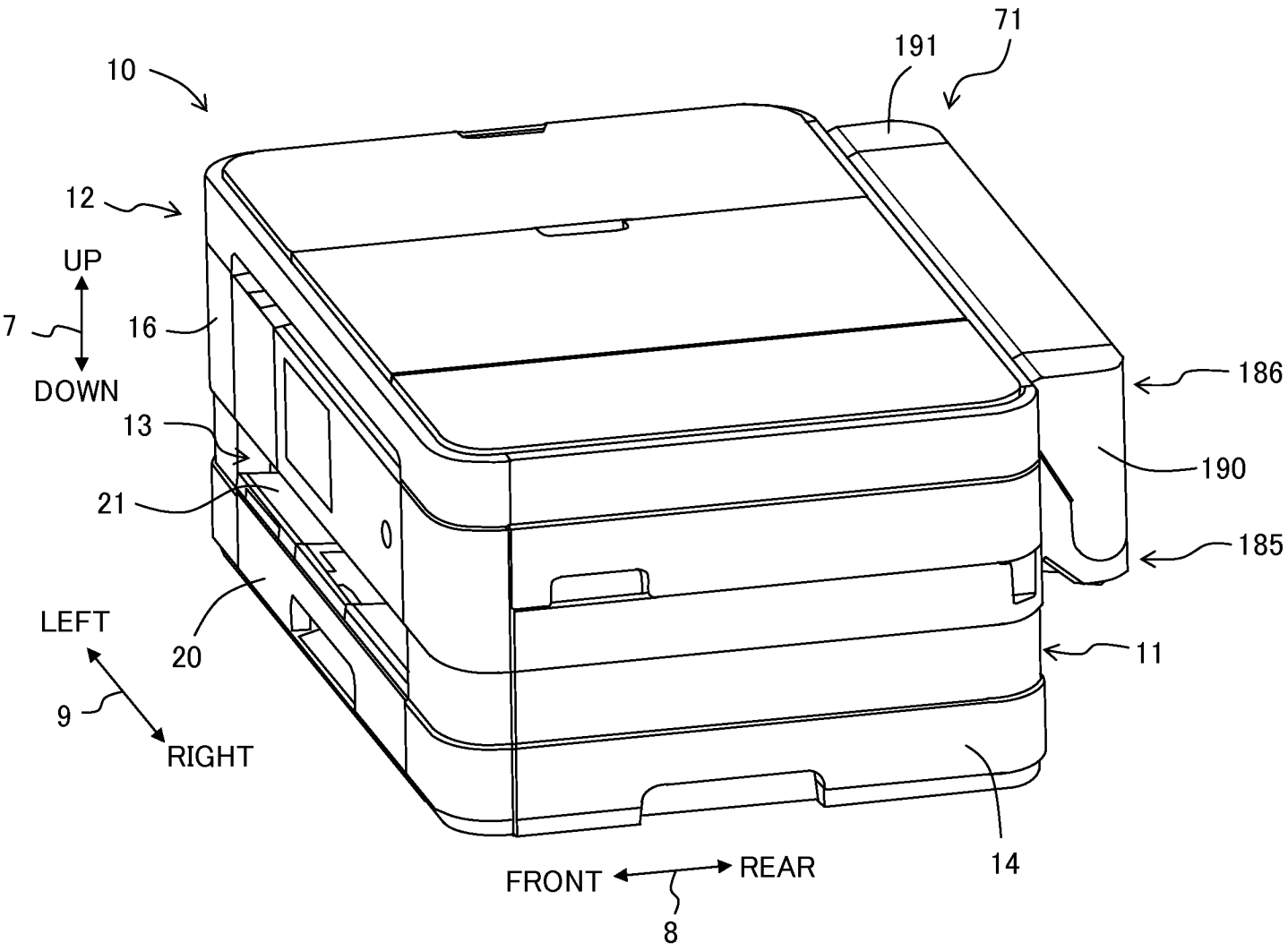
FIG. 1 is a perspective external view of a multifunction peripheral 10 in which a movable support unit 186 is in an upstanding state (a second position).

There will be explained a multifunction peripheral 10 according to an embodiment of the present teaching. It is needless to say that the embodiment to be explained below is merely an example of the present teaching, and it is possible to appropriately change the embodiment of the present teaching without departing from the gist and scope of the present teaching. In the following explanation, an up-down direction 7 of the multifunction peripheral 10 is defined on the basis of such a state that the multifunction peripheral 10 is placed to be usable (the state depicted in FIG. 1); a front-rear direction 8 of the multifunction peripheral 10 is defined as an opening 13 is provided on the near side (the front side); and a left-right direction 9 of the multifunction peripheral 10 is defined as the multifunction peripheral 10 is viewed from the near side (the front side).

<Entire Structure of Multifunction Peripheral 10>

As depicted in FIG. 1, the multifunction peripheral 10 is formed to have an approximately cuboid form, and the multifunction peripheral 10 includes a printer unit 11 of an inkjet recording system to record an image on a sheet such as a recording sheet. The multifunction peripheral 10 includes various functions such as a facsimile function and a print function.

The printer unit 11 has a casing 14 with the opening 13 formed in its front surface. Further, a feed tray 20 and a discharge tray 21 that can accommodate recording sheets of various sizes are insertable to and removable from the opening 13 in the front-rear direction 8. The bottom surface of the casing 14 abuts against a placement surface on which the multifunction peripheral 10 is placed.

Figure 2:
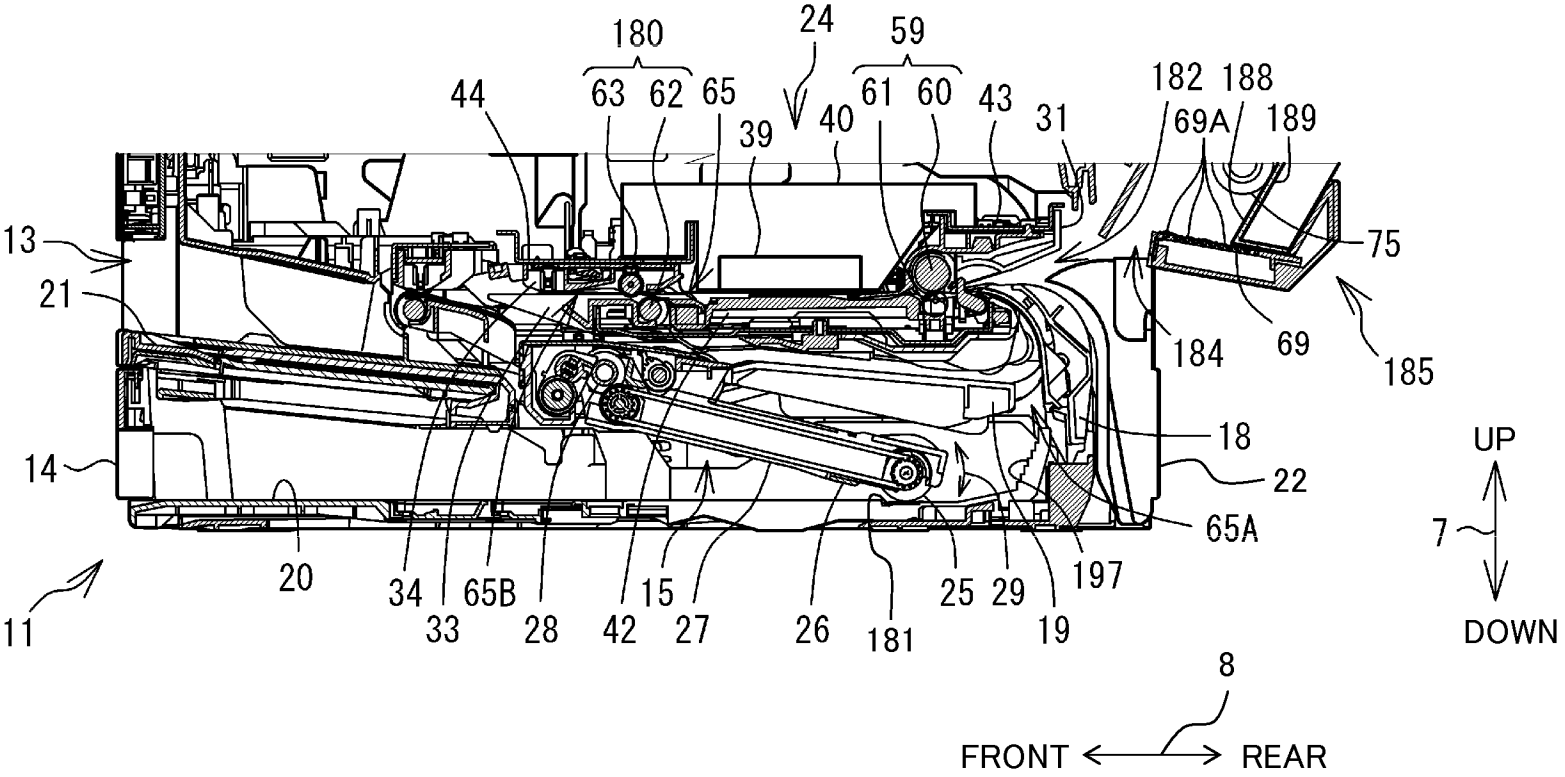
FIG. 2 is a vertical cross-sectional view depicting an internal structure of a printer unit 11.

As depicted in FIG. 2, the printer unit 11 includes a feed unit 15 that feeds the recording sheet from the feed tray 20, a recording unit 24 that records an image on the recording sheet, a first conveyance roller pair 59, a second conveyance roller pair 180, and the like.

As depicted in FIG. 1, a scanner unit 12 is provided above the printer unit 11. The width (length in the front-rear direction 8) and the depth (length in the left-right direction 9) of a casing 16 of the scanner unit 12 are the same as those of the casing 14 of the printer unit 11. The casing 14 of the printer unit 11 and the casing 16 of the scanner unit 12 come together to form an approximately cuboid outer form of the multifunction peripheral 10. The scanner unit 12 is a flatbed scanner. Incidentally, since the structure of the flatbed scanner is publicly known, any detailed explanation of which will be omitted herein. Further, in the scanner unit 12, an automatic document feeder (ADF) to feed a plurality of documents one by one separately may also be provided.

<Printer Unit 11>

The structure of the printer unit 11 will be explained in detail below. The printer unit 11 is one example of an image recording apparatus.

<Feed Tray 20>

The feed tray 20 depicted in FIG. 1 and FIG. 2 has a width (length in the front-rear direction 8) and a depth (length in the left-right direction 9) longer than a height (length in the up-down direction 7), and has a box-shaped form with the open upper surface. The discharge tray 21 is provided on the upper surface of the feed tray 20 at the front side. The feed tray 20 can accommodate recording sheets of various sizes such as, for example, the A4 size based on the Japanese Industrial Standards and the L size used for photograph recording, by supporting the recording sheets with a support surface. The feed tray 20 is detachably installed in the internal space communicating with the opening 13 of the casing 14. The feed tray 20 is movable back and forth in the front-rear direction 8 with respect to the casing 14 via the opening 13.

<Feed Unit 15>

As depicted in FIG. 2, the feed unit 15 includes a feed roller 25, a feed arm 26, a driving transmission mechanism 27, and a separating pad 181. The feed unit 15 is provided above the feed tray 20 and below the recording unit 24. The feed roller 25 is rotatably supported by the forward end of the feed arm 26. The feed arm 26 swings in the directions of an arrow 29 with a swing shaft 28 provided at the proximal end as the center of swing. Accordingly, the feed roller 25 can abut against the support surface of the feed tray 20 and the feed roller 25 can be separated therefrom. Therefore, in a case that the feed tray 20 loading the recording sheets is installed in the casing 14, the feed roller 25 can abut against the recording sheets accommodated in the feed tray 20. When the feed tray 20 accommodating no recording sheets is installed in the casing 14, the separating pad 181 is provided at the position against which the feed roller 25 abuts of the support surface of the feed tray 20. The separating pad 181 is formed of a material having a friction coefficient greater than that of the support surface of the feed tray 20 with respect to the recording sheet.

The driving force of a motor (not depicted) is transmitted to the feed roller 25 by the aid of the driving transmission mechanism 27. The driving transmission mechanism 27 transmits the rotation transmitted to the swing shaft 28 to the shaft of the feed roller 25 by an endless belt. The feed roller 25 is rotated in such a state that the feed roller 25 is allowed to abut against the recording sheet disposed on the uppermost side of the recording sheets supported by the support surface of the feed tray 20, and thus the uppermost recording sheet is fed to a conveyance path 65. In a case that the recording sheet is fed to the conveyance path 65, the forward end of the recording sheet abuts against a separating member 197 provided on the back side of the feed tray 20 in the front-rear direction 8. As a result, only the recording sheet disposed on the uppermost side is separated from the recording sheets disposed on a lower side and then conveyed. On the other hand, the recording sheets disposed on the lower side of the uppermost recording sheet are retained in the feed tray 20 without being dragged by the recording sheet disposed on the uppermost side.

<Conveyance Path 65>

As depicted in FIG. 2, the conveyance path 65, which is provided in the internal space of the casing 14, extends while being curved to make U-turn upward from the back side of the feed tray 20. Further, the conveyance path 65 is bent toward the front side from the back side of the printer unit 11, and then extends substantially straight to the front side of the printer unit 11 to arrive at the discharge tray 21. The conveyance path 65 is roughly classified into a curved passage 65A which makes U-turn and a straight passage 65B which is straight.

The curved passage 65A is defined by an outer guide member 18, an inner guide member 19, and a guide member 31. The outer guide member 18 and the inner guide member 19, the inner guide member 19 and the guide member 31, and the guide member 31 and the outer guide member 18 are respectively opposed to each other while being separated by the space through which the recording sheet can pass. The straight passage 65B is defined by the recording unit 24, a platen 42, a guide member 34, and a guide member 33. The recording unit 24 and the platen 42 are opposed to each other while being separated by the space through which the recording sheet can pass, and the guide member 34 and the guide member 33 are opposed to each other while being separated by the space through which the recording sheet can pass.

The recording sheet, which is fed to the conveyance path 65 by the feed roller 25 of the feed tray 20, is conveyed from a lower side to an upper side of the curved passage 65A. In this situation, a conveyance direction of the recording sheet is inverted from a backward direction to a forward direction. Then, the recording sheet is conveyed from the rear side to the front side in the front-rear direction 8 through the straight passage 65B without inverting the conveyance direction.

The outer guide member 18 is a member to form an outer guide surface when the recording sheet is conveyed through the curved passage 65A. The inner guide member 19 is a member to form an inner guide surface when the recording sheet is conveyed through the curved passage 65A. Incidentally, each of the guide surfaces may be formed by a single surface, or may also be formed as an envelope of forward ends of plural ribs.

The guide member 31 is disposed above the inner guide member 19 on the immediately upstream side (the back side) of the first conveyance roller pair 59. The outer guide member 18 and the guide member 31 also define a bypass route 182 to be described later.

<Back Surface Cover 22>

As depicted in FIG. 2, a back surface cover 22 is a member to support the outer guide member 18 and form a part of the back surface of the casing 14. The back surface cover 22 is swingably supported by the casing 14 at right and left both ends on the lower side. The back surface cover 22 swings around a swing shaft positioned on the lower side along the left-right direction 9 in such a manner that the upper side thereof falls down backward, and thereby a part of the bypass route 182 to be described later is opened or exposed to the outside of the casing 14.

The outer guide member 18 is also swingably supported by the casing 14 at right and left both ends on the lower side similarly to the back surface cover 22. In a state where the back surface cover 22 is swung to fall down backward, the outer guide member 18 is also swingable around a swing shaft positioned on the lower side along the left-right direction 9 in such a manner that the upper side thereof falls down backward. When the outer guide member 18 swings to fall down backward, at least a part of the curved passage 65A is opened or exposed. As depicted in FIG. 2, when the back surface cover 22 is closed to be brought into an upstanding state, the outer guide member 18 is supported by the back surface cover 22 from behind to be maintained in an upstanding state and defines the curved passage 65A while being opposed to the inner guide member 19.

<First Conveyance Roller Pair 59 and Second Conveyance Roller Pair 180>

As depicted in FIG. 2, in the conveyance path 65, the first conveyance roller pair 59 is provided on the upstream side of the recording unit 24 in the conveyance direction (forward direction in the front-rear direction 8). The first conveyance roller pair 59 has a first conveyance roller 60 and a pinch roller 61. In the conveyance path 65, the second conveyance roller pair 180 is provided on the downstream side of the recording unit 24 in the conveyance direction. The second conveyance roller pair 180 has a second conveyance roller 62 and a spur roller 63. The rotation of a motor (not depicted) is transmitted to the first and second conveyance rollers 60, 62, and thus the first and second conveyance rollers 60, 62 are allowed to rotate. The first conveyance roller pair 59 and the second conveyance roller pair 180 convey the recording sheet by rotating the first conveyance roller 60 and the second conveyance roller 62 in a state that the recording sheet is interposed between the respective rollers constructing the first conveyance roller pair 59 and the second conveyance roller pair 180.

<Recording Unit 24>

As depicted in FIG. 2, the recording unit 24 is provided between the first conveyance roller pair 59 and the second conveyance roller pair 180. The recording unit 24 includes a carriage 40 and a recording head 39. The carriage 40 is supported to be reciprocatively movable in the left-right direction 9 by guide rails 43, 44 provided on the back side and the front side of the platen 42. On the guide rail 44, a well-known belt mechanism is provided. The carriage 40 is coupled to an endless belt of the belt mechanism and reciprocates in the left-right direction 9 along the guide rails 43, 44 by swing of the endless belt. When the carriage 40 and the recording head 39 are opposed to each other across the platen 42 and a space, the carriage 40, the recording head 39, and the platen 42 define a part of the straight passage 65B.

The recording head 39 is carried on the carriage 40. A plurality of nozzles (not depicted) is formed on the lower surface of the recording head 39. Ink is supplied from ink cartridges (not depicted) to the recording head 39. The recording head 39 selectively discharges the ink as minute ink droplets from the plurality of nozzles. In a case that the carriage 40 is moved in the left-right direction 9, the ink droplets are discharged from the nozzles to the recording sheet supported by the platen 42. The discharged ink droplets adhere to the recording sheet on the platen 42, and thus an image is recorded on the recording sheet.

<Bypass Route 182>

As depicted in FIG. 2, an opening 184 is provided in the back surface of the casing 14 above the back surface cover 22. The bypass route 182, which extends from the opening 184 to the first conveyance roller pair 59, is formed in the casing 14. The bypass route 182 extends from the upper backward to the lower frontward in the casing 14. The bypass route 182 is defined by the guide member 31, the outer guide member 18, and the back surface cover 22. When the recording sheet is conveyed along the bypass route 182, the guide member 31 forms an upper guide surface. When the recording sheet is conveyed along the bypass route 182, the outer guide member 18 and the back surface cover 22 function as a lower guide surface. The curved passage 65A and the straight passage 65B of the conveyance path 65 are both disposed below the bypass route 182. The outer guide member 18 and the back surface cover 22 swing in such a manner that the upper sides thereof fall down backward, to thereby open (expose) a part of the conveyance path 65 and a part of the bypass route 182 to the outside of the casing 14.

Recording sheets accommodated in a bypass tray 71 to be described later are each guided obliquely downward via the bypass route 182. Each of the recording sheets is guided via the straight passage 65B of the conveyance path 65 and conveyed by the first conveyance roller pair 59. Then, the image recording is performed on the recording sheet by the recording unit 24 and the recording sheet is discharged on the discharge tray 21. As above, the recording sheets accommodated in the bypass tray 71 are each conveyed via a substantially straight path (a path where the front surface and the rear surface of the recording sheet are not inverted in the up-down direction 7).

<Feed Apparatus 70>

Figure 5:
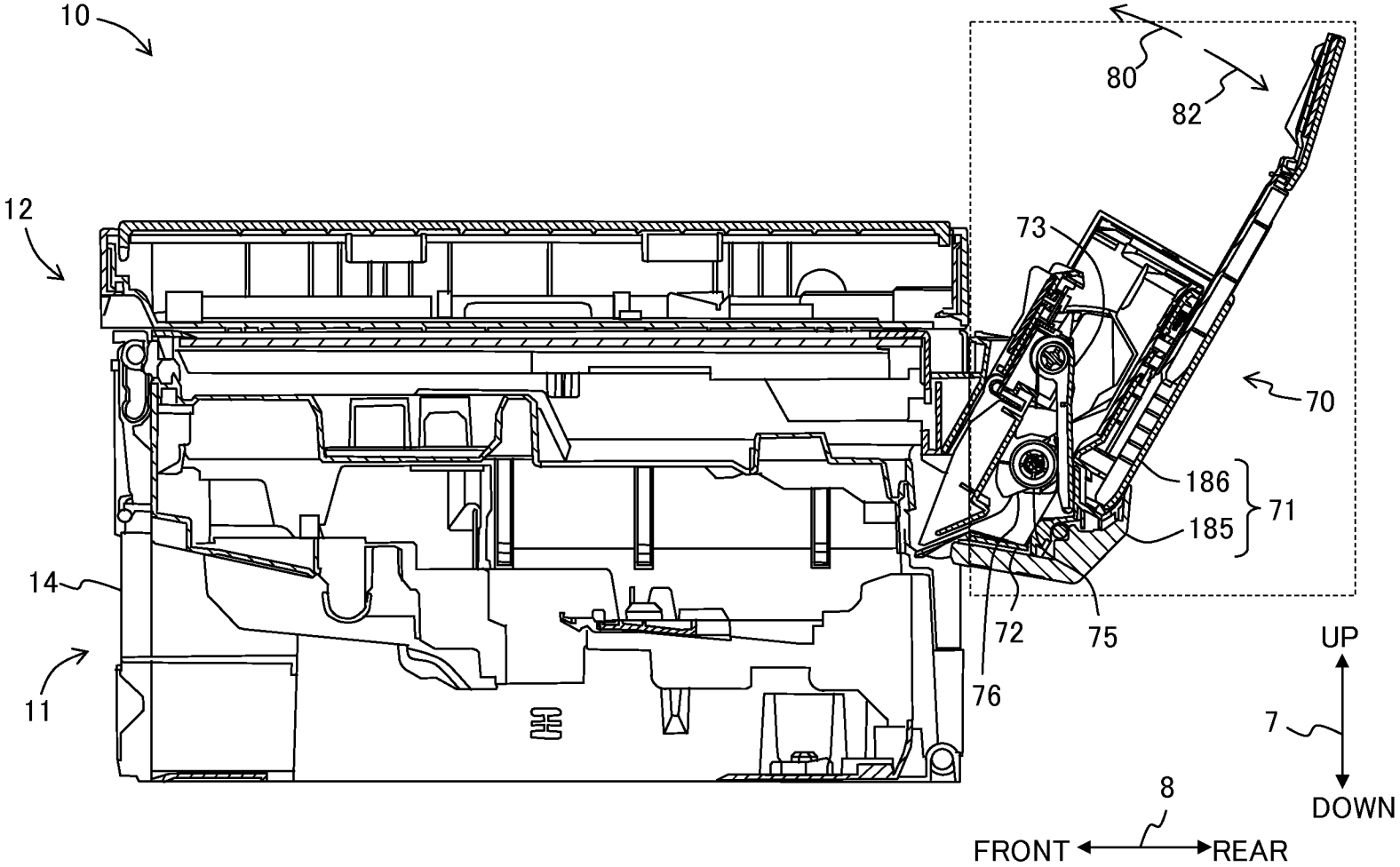
FIG. 5 is a vertical cross-sectional view of the multifunction peripheral 10 in which a holding arm 73 is positioned at the first position.
Figure 6:
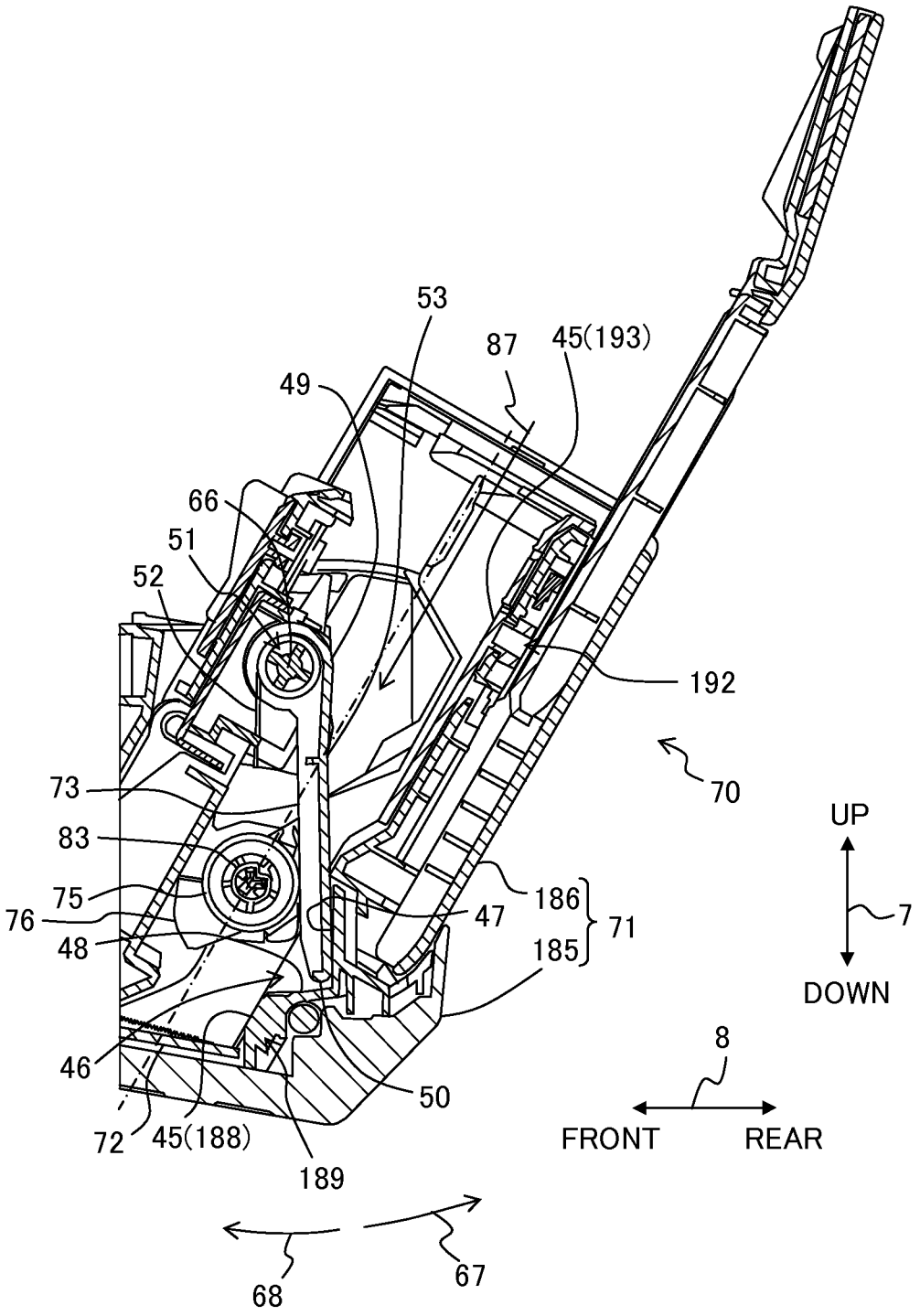
FIG. 6 is an enlarged view of a part enclosed in the rectangular frame depicted by dotted lines in FIG. 5.

As depicted in FIG. 5 and FIG. 6, the printer unit 11 includes a feed apparatus 70. The feed apparatus 70 includes the bypass tray 71, a feed roller 75, a feed arm 76, a not-depicted feed motor, a driving transmission mechanism 79, a holding arm 73, and a separating member 72.

<Bypass Tray 71>

As depicted in FIG. 1 and FIG. 5, the bypass tray 71 is provided on the back surface side of the multifunction peripheral 10. The bypass tray 71 accommodates recording sheets independently of the feed tray 20.

Figure 3:
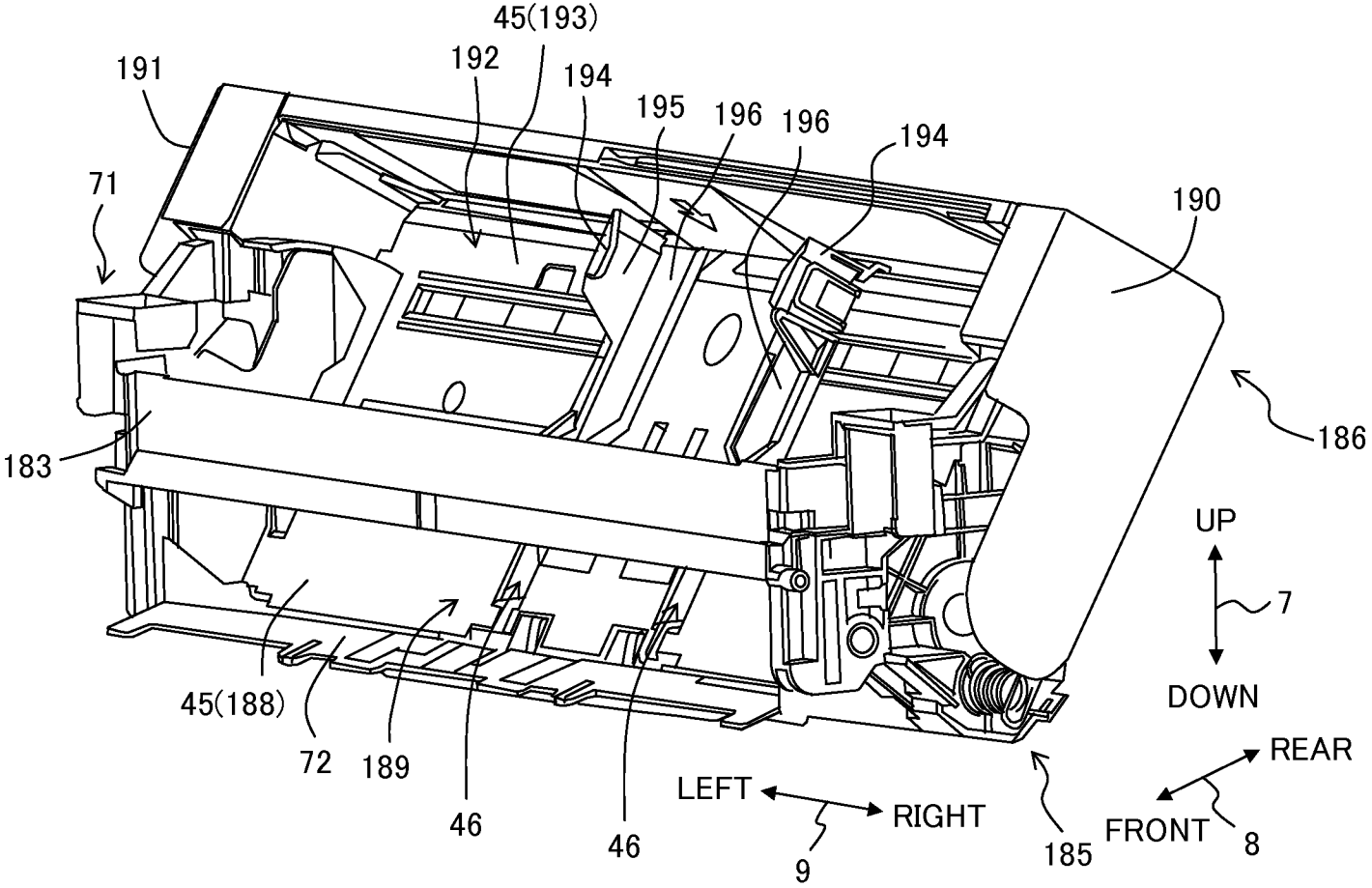
FIG. 3 is a perspective view depicting a bypass tray 71 when the movable support unit 186 is in an inclined state (a first position).
Figure 4:
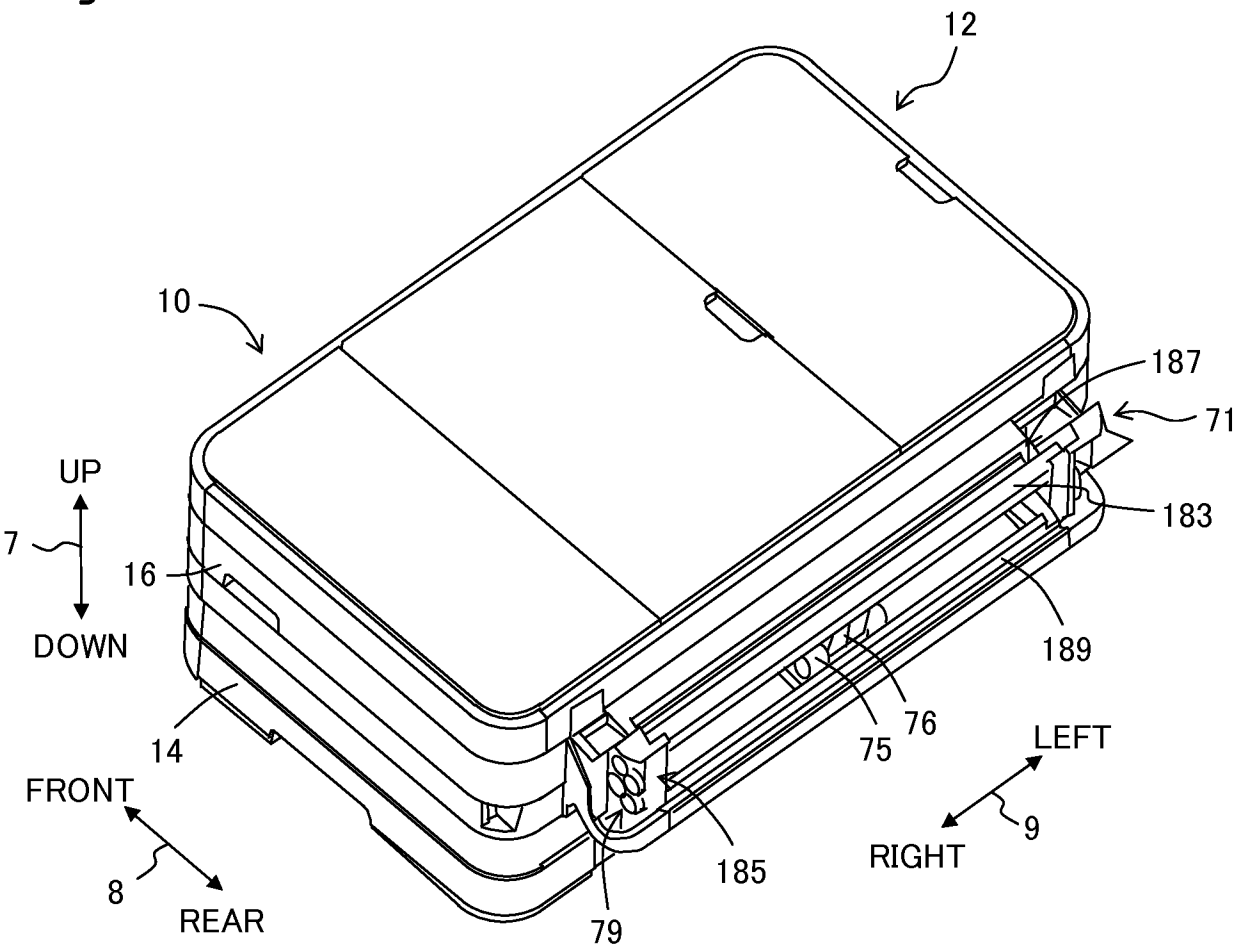
FIG. 4 is a perspective external view of the multifunction peripheral 10 on the back surface side in a state of the movable support unit 186 being removed therefrom.

As depicted in FIG. 1 and FIG. 4, on the back surface side of the casing 16 of the scanner unit 12, a fixed support unit 185 extending downward to cover the opening 184 (see FIG. 2) is provided. The fixed support unit 185 forms a part of the bypass tray 71 on the downstream side in the conveyance direction. As depicted in FIG. 3, a movable support unit 186 is provided on the upper side of the fixed support unit 185 so as to be swingable with respect to the fixed support unit 185. The bypass tray 71 is constructed by the fixed support unit 185 and the movable support unit 186.

As depicted in FIG. 4, in an upper surface of the fixed support unit 185, a slit-shaped opening 187 extending in the left-right direction 9 is formed. In the bypass tray 71, a passage is formed via the opening 187 to arrive at the bypass route 182 (see FIG. 2). As depicted in FIG. 3, a support member 189 including a support surface 188 (one example of a first support surface) is provided in the fixed support unit 185. The support surface 188 extends obliquely downward to the bypass route 182 (see FIG. 2). The lower end of the support member 189 forms a part of a guide surface guiding the recording sheet conveyed along the bypass route 182.

As depicted in FIG. 2, the separating member 72 is provided below the support member 189 of the fixed support unit 185. The separating member 72 is positioned at a height which is substantially the same as that of the opening 184 in the up-down direction 7. The upper surface of the separating member 72 is a surface against which the forward ends of the recording sheets supported by the bypass tray 71 abut. At a substantially center portion of the upper surface of the separating member 72 in the left-right direction 9, a separation piece 69 is provided. The separation piece 69 has a plurality of teeth 69A protruding upward from the upper surface of the separating member 72 and aligned along the front-rear direction 8. By the teeth 69A of the separation piece 69, the forward ends of the plural recording sheets supported by the bypass tray 71 are disentangled. Incidentally, in FIG. 3, the separation piece 69 is omitted.

On the upper end side of the support member 189 above the support surface 188, a reinforcing member 183 rotatably supporting a swing shaft 66 of the feed arm 76 (see FIG. 6) is provided as depicted in FIG. 3. The driving force is transmitted to the swing shaft 66 of the feed arm 76 supported by the reinforcing member 183 from the not-depicted feed motor via the driving transmission mechanism 79, and thereby the feed roller 75 rotates.

As depicted in FIG. 4, the driving transmission mechanism 79, which is composed of a plurality of pinion gears, is provided on the right side of the fixed support unit 185 in the left-right direction 9. The driving force is transmitted to the driving transmission mechanism 79 from the feed motor (not depicted) provided in the casing 14 of the printer unit 11. The swing shaft 66 extends in the left-right direction 9, and one end thereof is meshed or engaged with the pinion gears constituting the driving transmission mechanism 79. The other end of the swing shaft 66 extends to the center of the fixed support unit 185 in the left-right direction 9.

The swing shaft 66 swingably supports the feed arm 76. That is, the proximal end side (one example of the other end portion) of the feed arm 76 is swingable around the swing shaft 66. The feed roller 75 is rotatably supported by the swing forward end (one example of one end portion) of the feed arm 76. The feed arm 76 extends downward from the swing shaft 66 toward the support surface 188 of the support member 189. The feed arm 76 is disposed in the center of the fixed support unit 185 in the left-right direction 9.

The feed roller 75 is coupled to the swing shaft 66 by a not-depicted endless belt. The rotation of the swing shaft 66 is transmitted to the feed roller 75 by the endless belt, and thereby the feed roller 75 rotates. The feed roller 75 is rotated in a state of being allowed to abut against the recording sheet disposed on the uppermost side of the recording sheets supported by the support surface 188, and thus the uppermost recording sheet is fed via the bypass route 182 in a feed direction 87 (see FIG. 6). The recording sheets, which are disposed on the lower side of the uppermost recording sheet, are disentangled by the separation piece 69 of the separating member 72 and they are retained in the bypass tray 71 without being dragged by the recording sheet disposed on the uppermost side. As a result, only the uppermost recording sheet is separated from the other recording sheets to be fed via the bypass route 182 in the feed direction 87. As above, the feed unit composed of the feed roller 75, the swing shaft 66, and the feed arm 76 is disposed in the space above the support surface 188 outside the casing 14.

As depicted in FIG. 3 and FIG. 5, the movable support unit 186 is provided on the upper side of the fixed support unit 185 to be swingable with respect to the fixed support unit 185. The movable support unit 186 is swingable between the upstanding state in which the movable support unit 186 upstands in the up-down direction 7 as depicted in FIG. 1 (one example of a second position) and the inclined state in which the movable support unit 186 is inclined with respect to the up-down direction 7 as depicted in FIG. 5 (one example of a first position).

The upstanding state is a state for reducing the space for the movable support unit 186 on the back surface side of the casing 14, and the bypass tray 71 is not used when the movable support unit 186 is in the upstanding state. The back surface of the movable support unit 186 in the upstanding state is substantially parallel to the back surface of the casing 14. The movable support unit 186 in the upstanding state has the swing forward end thereof positioned substantially just above the swing proximal end thereof. In the upstanding state, the support surface 188 and the support surface 193 are disposed to intersect each other.

The inclined state is the state in which the movable support unit 186 is inclined obliquely upwardly toward the outside of the casing 14, and thus the inclined support surfaces 188, 193 are substantially provided as one flat surface, and the inclined state is the state in which the bypass tray 71 can be used. The movable support unit 186 in the inclined state has the swing forward end thereof positioned higher than the swing proximal end thereof, and the swing forward end is inclined to move away from the back surface of the casing 14 rather than the swing proximal end. Whether to bring the movable support unit 186 into the upstanding state or the inclined state can be selected by an arbitrary manipulation of the user.

As depicted in FIG. 1 and FIG. 3, sidewalls 190, 191 are provided at both ends of the movable support unit 186 in the left-right direction 9. The sidewalls 190, 191 cover parts of both sides of the fixed support unit 185 in the left-right direction 9 respectively. The driving transmission mechanism 79 provided on the right side of the fixed support unit 185 in the left-right direction 9 is covered with the sidewall 190 of the movable support unit 186.

As depicted in FIG. 3, a support member 192 extending to the sidewalls 190, 191 is provided in the movable support unit 186. In the inclined state of the movable support unit 186, the support surface 193 provided on the upper surface of the support member 192 and the support surface 188 form substantially the same flat surface. That is, a surface 45, which is formed by the support surface 188 of the support member 189 and the support surface 193 of the support member 192, supports the recording sheet in the bypass tray 71. In the upstanding state, the support surface 193 is brought into a state perpendicular to the placement surface of the multifunction peripheral 10, namely a state of being positioned along the up-down direction 7 and the left-right direction 9. Incidentally, in this embodiment, the placement surface on which the multifunction peripheral 10 is placed is a surface extending along the left-right direction 9 and the front-rear direction 8. Here, "substantially one flat surface (the same flat surface)" means a flat surface on which the supported recording sheet is neither bent nor flexed even when there is a small difference in height between two surfaces constituting the flat surface; in other words, it means a flat surface on which the recording sheet is supported so that separation performance is stably obtained by the above-described separating member 72 (the separation piece 69).

As depicted in FIG. 3, a pair of side guides 194 is provided on the support member 192. The paired side guides 194 are provided separated from each other in the left-right direction 9 and protrude upward from the support surface 193. The side guides 194 each have a guide surface 195 extending along the conveyance direction of the bypass tray 71. When the recording sheet on the support surface 193 is conveyed, end edges of the recording sheet along the conveyance direction are guided by the guide surfaces 195.

The side guides 194 each have a support surface 196 along the support surface 193 of the support member 192. That is, the side guides 194 each form an L shape with the guide surface 195 and the support surface 196 perpendicular to each other. The support surface 196 and the support surface 193 form substantially the same flat surface even though there is a small difference in height therebetween, and the support surfaces 196 support the recording sheet with the support surfaces 188, 193. The distance of which the paired side guides 194 are moved away from each other along the left-right direction 9 varies. This makes it possible to guide end edges of recording sheets in various sizes supported by the support surfaces 193, 196 by the guide surfaces 195 of the side guides 194.

As depicted in FIG. 3 and FIG. 6, two recesses 46 are provided in the surface 45 of the bypass tray 71 (the support surface 188 of the support member 189). The other end 50 of the holding arm 73 to be described later is inserted into the recesses 46. The two recesses 46 are provided at the same position in the feed direction 87. Further, the two recesses 46 are respectively provided on the right side and left side of the paired feed rollers 75 in the left-right direction 9. That is, the two recesses 46 are provided to interpose the paired feed rollers 75 therebetween.

Further, as depicted in FIG. 6, the recesses 46 are each provided with a first inclined surface 47 and a second inclined surface 48. The first inclined surface 47 defines, of each of the recesses 46, the upstream side in the feed direction 87. The first inclined surface 47 is inclined to be away from the support surface 188 as it goes to the downstream side in the feed direction 87. An inclination angle of the first inclined surface 47 is substantially the same as that when the later-described holding arm 73 is positioned at the first position.

The second inclined surface 48 defines, of each of the recesses 46, the downstream side in the feed direction 87. The second inclined surface 48 is provided continuously from the downstream end of the first inclined surface 47 in the feed direction 87, and is inclined to be close to the support surface 188 as it goes to the downstream side in the feed direction 87.

Incidentally, the shape of the recess 46 is not limited to the above-described shape demarcated by the first inclined surface 47 and the second inclined surface 48 as long as the other end 50 of the holding arm 73 can be inserted into the recess 46. For example, the recess 46 may also be recessed in a rectangular shape.

<Feed Roller 75 and Feed Arm 76>

As depicted in FIG. 6, the feed roller 75 is disposed on the frontward side of the bypass tray 71. The feed roller 75 can abut against the support surface 188 of the support member 189. A rotational shaft 83 of the feed roller 75 extends in the left-right direction 9. Incidentally, although two feed rollers 75 are provided with a spacing distance intervening therebetween in the left-right direction 9, the number of feed rollers 75 is not limited to two.

The feed arm 76 extends in a state of being inclined to the support surface 188 at a position above the support surface 188. The feed arm 76 extends from its one end to be away from the surface 45 of the bypass tray 71 toward the upstream side in the feed direction 87. The feed roller 75 is rotatably supported via the rotational shaft 83 at one end of the feed arm 76. The swing shaft 66 is inserted through a hole provided at an upstream-side end of the feed arm 76 in the feed direction 87, namely at the other end of the feed arm 76. Accordingly, the feed arm 76 swings with the swing shaft 66 as the center of swing. As a result, the feed roller 75 can abut against the support surface 188 of the support member 189 or the recording sheet supported by the support surface 188 and the feed roller 75 can be separated therefrom. Incidentally, the swing shaft 66 is rotatably supported by the reinforcing member 183 as described above.

The feed arm 76 is connected to the swing shaft 66 by a torsion spring (not depicted). Accordingly, the feed arm 76 is biased by the torsion spring in the direction of separating pads 170. Incidentally, the structure for basing the feed arm 76 is not limited to a structure using the torsion spring. For example, a coil spring may be disposed on the frontward side of the feed arm 76 such that one end of the coil spring is connected to the feed arm 76 and the other end of the coil spring is connected to a frame of the printer unit 11.

In this embodiment, the feed arm 76 is swingable by obtaining a driving force from a contact-separating mechanism. Here, the structure of the contact-separating mechanism may be any publicly known structure on condition that the feed arm 76 is swingable around the swing shaft 66. In a case that the recording sheet supported by the bypass tray 71 is fed, the contact-separating mechanism causes the feed arm 76 to swing in the direction of an arrow 67 so that the feed roller 75 abuts against the recording sheet supported by the surface 45. On the other hand, in a case that the recording sheet supported by the bypass tray 71 is not fed, the contact-separating mechanism causes the feed arm 76 to swing in the direction of an arrow 68 so that the feed roller 75 is separated from the support surface 188 of the support member 189. Incidentally, in FIG. 5 and FIG. 6, the feed roller 75 is separated from the support surface 188 by the contact-separating mechanism.

<Holding Arm 73>

As depicted in FIG. 6, similar to the feed arm 76, the holding arm 73 extends at a position above the support surface 188. The holding arm 73 extends from one end 49 to be closer to the support surface 188 of the support member 189 toward the downstream side in the feed direction 87. That is, the one end 49 of the holding arm 73 is positioned at the upstream side of the other end 50 in the feed direction 87, and the distance between the one end 49 and the surface 45 is greater than the distance between the other end 50 and the surface 45. The swing shaft 66 is inserted through a hole 51 provided on the side of the upstream-side end of the holding arm 73 in the feed direction 87, namely on the side of the one end 49. Accordingly, the holding arm 73 swings with the swing shaft 66 as the center of swing in the same manner as the feed arm 76. That is, the holding arm 73 is swingable with the side of the one end 49 as the swing shaft and with the side of the other end 50 as the side of the forward end of the swing. As a result, the side of the forward end of the holding arm 73 can abut against the support surface 188 or the recording sheet supported by the support surface 188 and the side of the forward end of the holding arm 73 can be separated therefrom.

As described above, the swing shaft 66 is inserted through both the feed arm 76 and the holding arm 73. Therefore, the center of the swing shaft of the feed arm 76 is the same as the center of the swing shaft of the holding arm 73. Further, the feed arm 76 and the holding arm 73 are swingable independently of each other.

The other end 50 of the holding arm 73 is curved to be convex toward the downstream side in the feed direction 87 as viewed from the left side or the right side (the far side or the near side in the vertical direction with respect to the paper surface) as depicted in FIG. 6.

The number of holding arms 73 provided is the same as the number of recesses 46 provided in the support surface 188 of the support member 189. That is, in this embodiment, each of the holding arms 73 is provided on the right side or the left side of the feed rollers 75. Each of the two holding arms 73 corresponds to one of the two recesses 46.

The width of the other end 50 of the holding arm 73 in the left-right direction 9 is narrower than the width of the corresponding recess 46. Accordingly, as depicted in FIG. 6, the other end 50 of the holding arm 73 is capable of entering the recess 46. The position of the holding arm 73 at this time corresponds to the first position. On the other hand, the holding arm 73 swings in the direction of the arrow 68 from the first position, and thus the other end 50 of the holding arm 73 is retractable from the recess 46. The position of the holding arm 73 at this time corresponds to the second position. The holding arm 73 is swingable between the first position and the second position.

As depicted in FIG. 6, in a case that the holding arm 73 is positioned at the first position, a surface 53 being a part which is included in the surface of the holding arm 73 on the upstream side in the feed direction 87 and which does not enter the recess 46 is positioned on the upstream side of the feed roller 75 in the feed direction 87. In a case that the holding arm 73 is positioned at the second position, the other end 50 of the holding arm 73 is positioned on the downstream side of the feed roller 75 in the feed direction 87.

The holding arm 73 is connected to the swing shaft 66 by the torsion spring 52. Accordingly, the holding arm 73 is biased by the torsion spring 52 toward the side of the first position. Incidentally, the structure for basing the holding arm 73 is not limited to the structure using the torsion spring 52. For example, a coil spring may be disposed on the frontward side of the holding arm 73 such that one end of the coil spring is connected to the holding arm 73 and the other end of the coil spring is connected to the frame of the printer unit 11.

<Support Members 189, 192 and Separating Pads 170>

Figure 7:
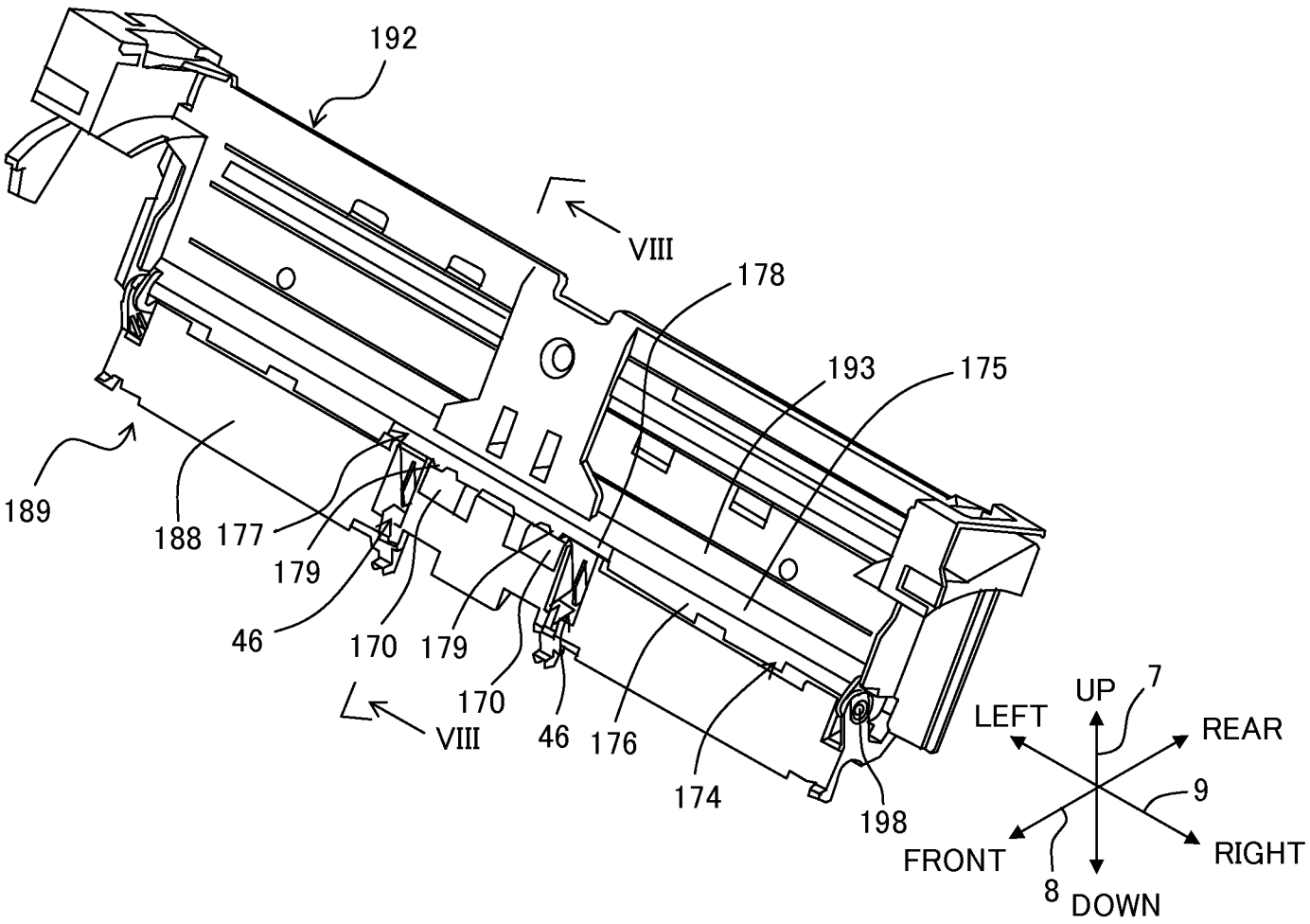
FIG. 7 is a perspective view depicting support members 189, 192 and separating pads 170 when the movable support unit 186 is positioned at the first position.
Figure 8:
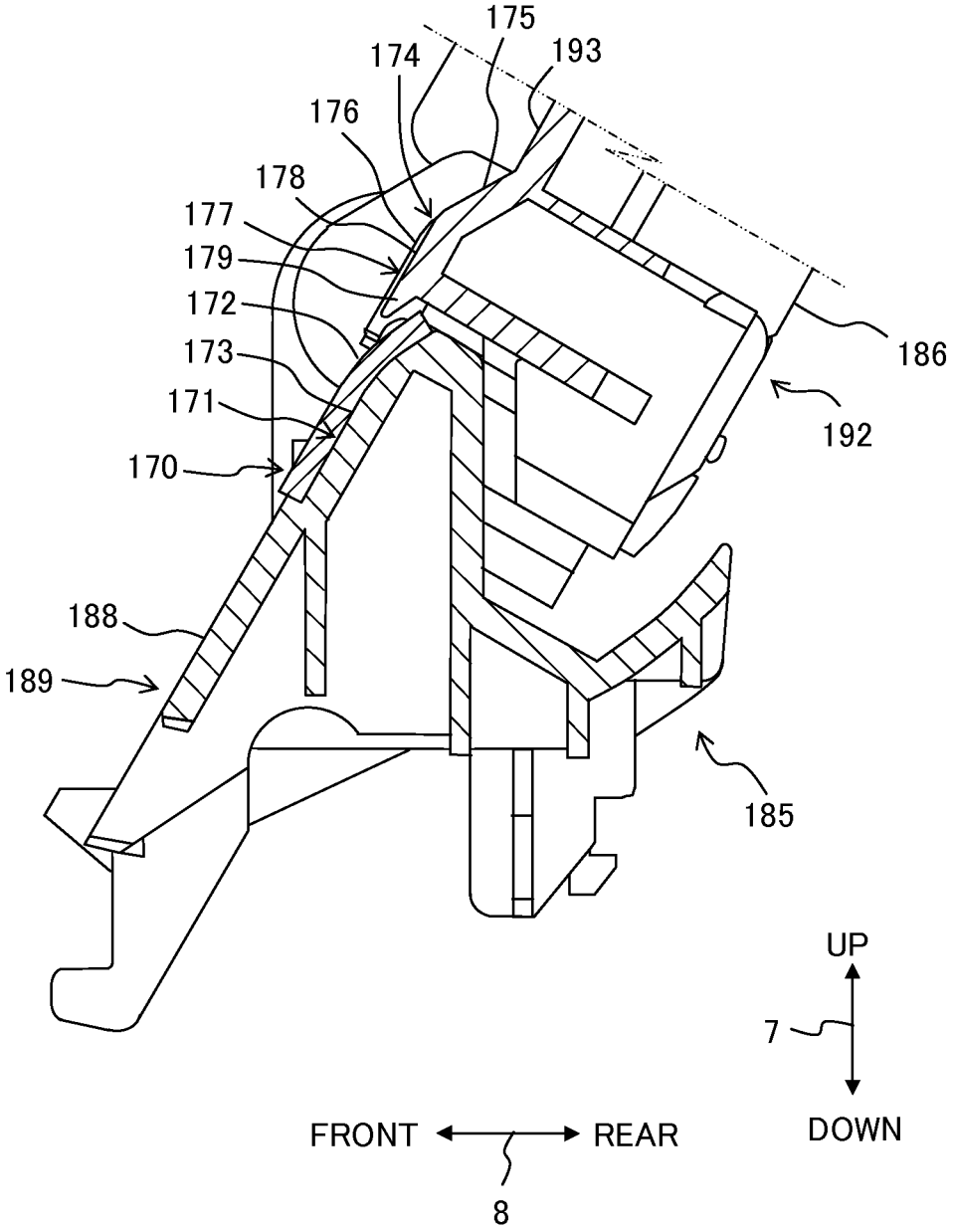
FIG. 8 is a cross-sectional view illustrating a cross section taken along VIII-VIII in FIG. 7.
Figure 9:
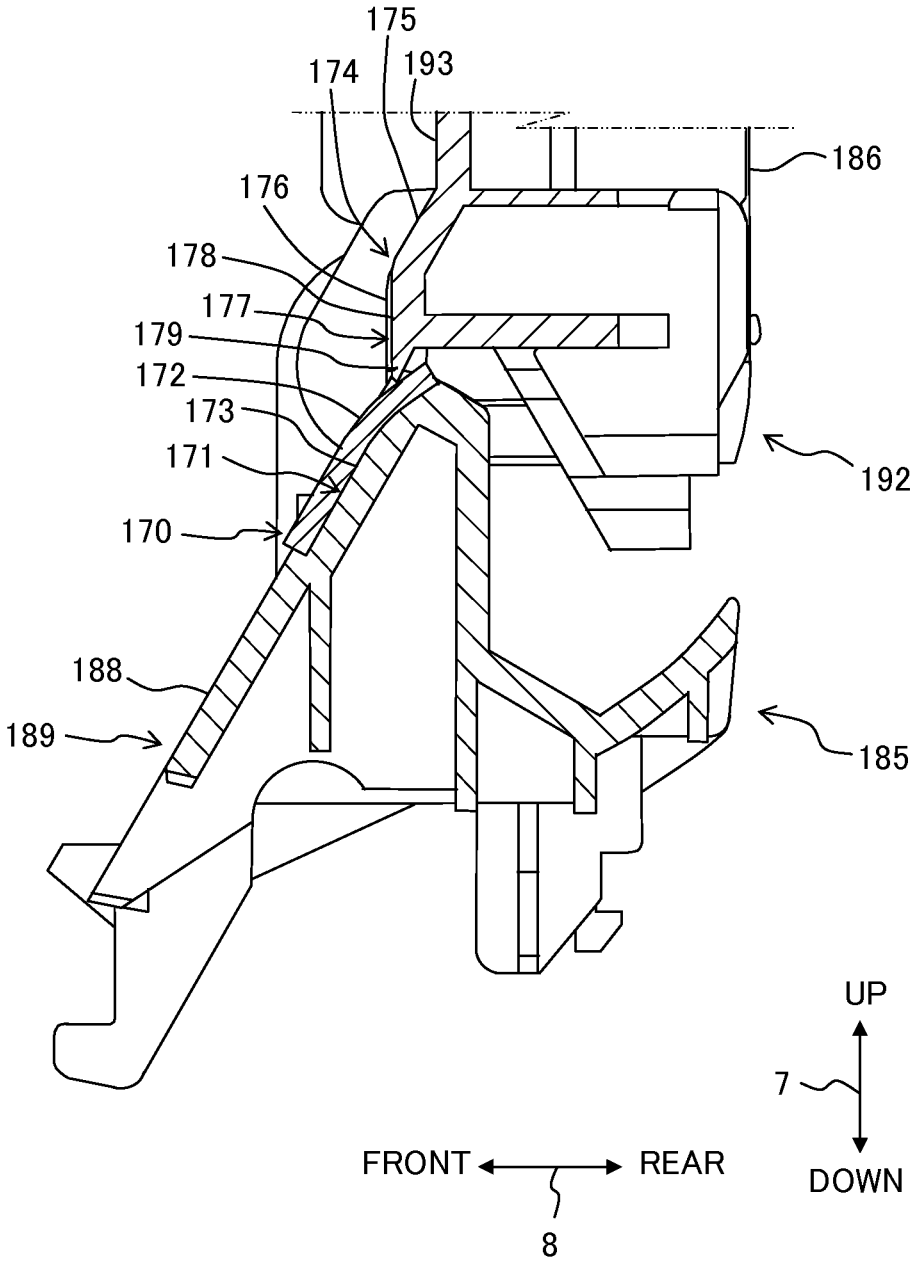
FIG. 9 is a cross-sectional view depicting a cross section taken along VIII-VIII in FIG. 7 when the movable support unit 186 is positioned at the second position.

As depicted in FIG. 7 to FIG. 9, on the support surface 188 of the support member 189, the two separating pads 170 are provided at the positions against which the feed rollers 75 abut. The separating pads 170 are each formed of a material having a friction coefficient higher than that of the support surface 188 with respect to the recording sheet. The separating pad 170 has a rectangular flat plate shape having a substantially uniform thickness.

In the support surface 188 of the support member 189, at the upper end in the up-down direction 7 and at the vicinity of the center in the left-right direction 9, namely at the two positions opposed to the feed rollers 75, a recess 171 is formed. The separating pads 170 are inserted into the recesses 171 to be bonded to bottom surfaces 173 of the recesses 171 individually. The depth of which the recess 171 is recessed from the support surface 188 is slightly shorter than the thickness of the separating pad 170. Thus, when the movable support unit 186 is positioned at the first position, a top surface 172 (one example of the front surface) of the separating pad 170 inserted into the recess 171 is positioned slightly higher than the support surface 188. In other words, the separating pad 170 slightly protrudes from the support surface 188.

The bottom surface 173 of the recess 171 is curved to gradually go away from the support surface 188 toward the upper end side in the up-down direction 7. Along the curve of the bottom surface 173, the upper end side of the separating pad 170 is also curved. Due to this curve, the upper end of the top surface 172 of the separating pad 170 is positioned lower than the support surface 188 when the movable support unit 186 is positioned at the first position. That is, the upper end of the top surface 172 of the separating pad 170 is recessed downward rather than the support surface 188. The curve of the bottom surface 173 of the recess 171 is based on a supporting shaft 198 of the movable support unit 186 generally.

As depicted in FIG. 7, on the lower end side of the support member 189, a bulge 174 extending in the left-right direction 9 is formed. The bulge 174 has a convex shape bulging upward from the support surface 193. When the movable support unit 186 is positioned at the first position, on the upper side of the bulge 174, an inclined surface 175 inclined upward gradually from the support surface 193 (to the direction away from the support surface 193), which extends in the left-right direction 9, is formed. On the lower side of the inclined surface 175, namely on the support member 189 side, a bulging end surface 176 (one example of a bulging end) is formed continuously from the inclined surface 175. The bulging end surface 176 is a surface substantially parallel to the support surface 193. The bulging end surface 176 extends down to the lower end of the support member 192.

At the center portion of the bulge 174 in the left-right direction 9, a recess 177 is formed. In the region in the left-right direction 9 occupied by the recess 177 (the width of the recess 177), the dispositions of the two separating pads 170 in the left-right direction 9 are included. That is, the left end of the recess 177 is positioned leftward rather than the left separating pad 170, and the right end of the recess 177 is positioned rightward rather than the right separating pad 170. When the movable support unit 186 is positioned at the first position, a bottom surface 178 of the recess 177 (one example of the bulging end) is positioned higher than the support surface 193 of the support member 192 and the top surface 172 of the separating pad 170 in a direction perpendicular to the support surface 188, and is at a position closer to the support surface 193 rather than the bulging end surface 176 of the bulge 174 in a direction perpendicular to the support surface 188.

On the lower end of the recess 177 (the end on the support member 189 side), protrusion pieces 179 to protrude toward the two separating pads 170 individually when the movable support unit 186 is positioned at the first position are formed to extend from the bottom surface 178. The dimension of each of the protrusion pieces 179 in the left-right direction 9 is smaller than that of each of the separating pads 170 in the left-right direction 9. The dimension of each of the protrusion pieces 179 protruding from the lower end of the recess 177 toward the separating pad 170 is set to such an extent that the protrusion piece 179 does not abut against the separating pad 170 when the movable support unit 186 swings between the first position and the second position.

As depicted in FIG. 8 and FIG. 9, when the support member 192 swings around the supporting shaft 198 between the first position and the second position, the forward ends of the protrusion pieces 179 also move around the supporting shaft 198. The curve of the bottom surface 173 of the recess 171 in the support member 189 is based on the supporting shaft 198 of the movable support unit 186 generally, so that the distance between the top surface 172 of the separating pad 170 curved along the curve and the forward end of the protrusion piece 179 becomes constant generally when the support member 192 swings.

As depicted in FIG. 8, when the support member 192 is positioned at the first position, the recording sheet to be loaded into the bypass tray 71 is inserted obliquely downward along the support surface 193 of the support member 192. At this time, the forward end of the recording sheet is guided to the bulging end surface 176 from the support surface 193 along the inclined surface 175 of the bulge 174. The bulging end surface 176 is positioned higher than the support surfaces 188, 193 in a direction perpendicular to the support surface 188. That is, a slope inclined downward is made from the bulging end surface 176 to the support surface 183 and from the bulging end surface 176 to the support surface 193. Thereby, the forward end of the recording sheet that has passed through the bulging end surface 176 arrives at the support surface 188 without abutting against the corner of the upper end of the support surface 188.

Further, in the recess 177 of the bulge 174, the forward end of the recording sheet is guided along the bottom surface 178. The bottom surface 178 of the recess 177 is positioned higher than the support surface 188 and the top surfaces 172 of the separating pads 170 in a direction perpendicular to the support surface 188. That is, a slope inclined downward is made from the bottom surface 178 to the top surfaces 172 or from the bottom surface 178 to the support surface 188. Thereby, the forward end of the recording sheet that has passed through the bottom surface 178 arrives at the support surface 188 or the top surfaces 172 of the separating pads 170 without abutting against the corner of the upper end of the support surface 188 and the corners of the upper ends of the top surfaces 172 of the separating pads 170. Further, due to the protrusion pieces 179, a gap between the bottom surface 178 and the top surfaces 172 of the separating pads 170 is made small, so that it is further difficult for the forward end of the recording sheet that has passed through the bottom surface 178 to abut against the corners of the upper ends of the top surfaces 172 of the separating pads 170.

The recording sheet loaded into the bypass tray 71 is maintained in a state of abutting against the support surfaces 188, 193 by the holding arms 73 and the feed rollers 75. The upper end side of the separating pad 170 is curved to be positioned lower than the support surface 188 in a direction perpendicular to the support surface 188, so that there is no case that the recording sheet in a state of abutting against the support surfaces 188, 193 abuts against the corners of the upper ends of the separating pads 170. Further, on the vicinity of the center of the support member 192 in the left-right direction 9, the recording sheet is supported by the bottom surface 178 of the recess 177 closer to the top surfaces 172 of the separating pads 170 rather than the bulging end surface 176 of the bulge 174. In other words, the difference in height between the bottom surface 178 of the recess 177 and the top surfaces 172 of the separating pads 170 in a direction perpendicular to the support surface 188 is smaller than the difference in height between the bulging end surface 176 and the top surfaces 172 of the separating pads 170 in a direction perpendicular to the support surface 188, and at the place of the small difference in height, the recording sheet abuts against the separating pads 170. Thus, the recording sheet coming into contact with both the bottom surface 178 of the recess 177 and the top surfaces 172 of the separating pads 170 bends only for the small difference in height. That is, the recording sheet does not bend as much as it does for the difference in height between the bulging end surface 176 and the separating pads 170, so that even if the recording sheet is a recording sheet with high stiffness (strong stiffness) tentatively, the recording sheet abuts against the separating pads 170 with a stable contact area.

<Effects of this Embodiment>

As described above, according to the feed apparatus 70, downsizing of the feed apparatus 70 can be achieved by bringing the movable support unit 186 to the second position. Further, at the upper end of the support surface 188, the top surfaces 172 of the separating pads 170 are curved downward rather than the support surface 188, so that it is possible to prevent that the support member 192 to swing around the supporting shaft 198 comes into contact with the separating pads 170, to thereby cause abrasion of the top surfaces 172 of the separating pads 170 and peeling of the separating pad/pads 170 off the recess/recesses 171. The recording sheet supported by the support member 192 does not abut against the corners of the upper ends of the separating pads 170, and a contact area of the recording sheet on the top surfaces 172 of the separating pads 170 is stabilized. This can reduce the possibility of occurrence of overlapped feed of recording sheets in the bypass tray 71.

Further, on the support member 192, the protrusion pieces 179 protruding to the separating pads 170 are provided, thereby making it possible to reduce the gap between the bottom surface 178 of the recess 177 and the separating pads 170.

Further, the bulge 174 is provided on the lower end of the support member 192, so that the forward end of the recording sheet to be inserted into the support member 189 side along the support surface 196 of the support member 192 is prevented from abutting against the upper end of the support member 189. Further, the bottom surface 178 of the recess 177 at the position corresponding to the separating pads 170 is closer to the separating pads 170 than the bulging end surface 176 of the bulge 174, so that the difference in height between the bottom surface 178 and the top surfaces 172 of the separating pads 170 is small and the contact area of the recording sheet on the top surfaces 172 of the separating pads 170 is stabilized.

Modified Embodiments

Incidentally, in the above-described embodiment, the bulge 174 is provided on the lower end of the support member 192, but the bulge 174 may also be omitted as long as the support surface 193 of the support member 192 is positioned higher than the support surface 188 of the support member 189 and the top surfaces 172 of the separating pads 170 in a direction perpendicular to the support surface 188 when the movable support unit 186 is positioned at the first position.

Further, in the above-described embodiment, the number of separating pads 170 is two, but this corresponds to the number of feed rollers 75 and the number of separating pads 170 is not limited to two.

Further, in the above-described embodiment, the feed apparatus 70 is an apparatus to feed the recording sheets supported by the bypass tray 71, but the feed apparatus 70 may also be an apparatus for feeding the recording sheets supported by the feed tray 20. As long as, for example, the portion of the feed tray 20 anterior to the separating pad 181 is formed to swing, the constitution similar to that of the above-described bypass tray 71 is employed, resulting in that the similar effects are obtained.

Further, in the above-described embodiment, the feed apparatus 70 is provided in the printer unit 11, but an apparatus or unit for which the feed apparatus 70 is provided is not limited to the printer unit 11. For example, the feed apparatus 70 may also be provided in the scanner unit 12. In this case, the feed apparatus 70 is to feed a sheet with an image to be read by the scanner unit 12 to the inside of the scanner unit 12.

What is claimed is:

1. A feed apparatus configured to feed a sheet, comprising:

a fixed support unit including a first support surface configured to support the sheet;

a movable support unit including a second support surface configured to support the sheet and configured to move to a first position and a second position with respect to the fixed support unit, the first position being a position at which the first support surface and the second support surface form substantially one flat surface and the second position being a position at which the second support surface intersects with the first support surface, the one flat surface being inclined with respect to a horizontal surface;

a feed roller configured to feed, in a feed direction, the sheet supported by the second support surface of the movable support unit positioned at the first position and the first support surface;

an arm including one end portion configured to rotatably support the feed roller and the other end portion configured to be swingable with respect to a shaft provided in the fixed support unit; and a separating pad provided in an area, of the first support surface, which includes an end of the first support surface on the second support surface side and which is opposed to the feed roller, wherein a surface of the separating pad at an end on the second support surface side is more concave than the second support surface positioned at the first position.

2. The feed apparatus according to claim 1, wherein the movable support unit includes a protrusion protruding toward the separating pad from the second support surface.

3. The feed apparatus according to claim 1, wherein the movable support unit includes a bulge portion configured to bulge out from the first support surface, along the end of the second support surface on the first support surface side, under a condition that the movable support unit is positioned at the first position, and a height, from the first support surface, of one of bulging ends of the bulge portion which is located at a position corresponding to the separating pad is lower than the bulging ends other than the one of the bulging ends.

4. The feed apparatus according to claim 1, wherein a friction coefficient of the separating pad with respect to the sheet is greater than a friction coefficient of the first support surface with respect to the sheet.

5. An image recording apparatus, comprising:

the feed apparatus according to claim 1; and a recording unit configured to record an image on a sheet fed by the feed roller of the feed apparatus.

* * * * *